US012467225B2

(12) United States Patent
Itoh et al.

(10) Patent No.: US 12,467,225 B2
(45) Date of Patent: Nov. 11, 2025

(54) WORK MACHINE ASSISTING OPERATION OF OPERATOR BY PERFORMING SEMI-AUTOMATIC CONTROL

(71) Applicant: HITACHI CONSTRUCTION MACHINERY CO., LTD., Tokyo (JP)

(72) Inventors: Masamichi Itoh, Ushiku (JP); Teruki Igarashi, Tsuchiura (JP); Akihiro Narazaki, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 615 days.

(21) Appl. No.: 17/274,926

(22) PCT Filed: Nov. 29, 2019

(86) PCT No.: PCT/JP2019/046852
§ 371 (c)(1),
(2) Date: Mar. 10, 2021

(87) PCT Pub. No.: WO2020/194878
PCT Pub. Date: Oct. 1, 2020

(65) Prior Publication Data

US 2022/0025608 A1 Jan. 27, 2022

(30) Foreign Application Priority Data

Mar. 26, 2019 (JP) ..... 2019-059361

(51) Int. Cl.
*E02F 3/43* (2006.01)
*E02F 3/32* (2006.01)
(Continued)

(52) U.S. Cl.
CPC ..... *E02F 3/439* (2013.01); *E02F 3/32* (2013.01); *E02F 9/2004* (2013.01);
(Continued)

(58) Field of Classification Search
CPC . E02F 3/439; E02F 3/32; E02F 9/2004; E02F 9/2041; E02F 9/2203; E02F 9/2271;
(Continued)

(56) References Cited

U.S. PATENT DOCUMENTS

2012/0155999 A1* 6/2012 Morimoto ..... E02F 9/2217 701/50
2016/0281331 A1* 9/2016 Ikegami ..... E02F 9/2285
(Continued)

FOREIGN PATENT DOCUMENTS

JP 2016-169571 A 9/2016
JP 2018-135681 A 8/2018
(Continued)

OTHER PUBLICATIONS

Merriam-Webster, "maintain," 2006. (Year: 2006).*
(Continued)

*Primary Examiner* — Aniss Chad
*Assistant Examiner* — Stephanie T Su
(74) *Attorney, Agent, or Firm* — Mattingly & Malur, PC

(57) ABSTRACT

When a bucket 10 is grounded on soil, an operation signal is outputted or corrected such that a relative angle of the bucket 10 with respect to a target surface is maintained if a distance D between the bucket 10 and the target surface 60 is equal to or less than a preset first threshold value D1. When the bucket 10 is not grounded on soil, the operation signal is outputted or corrected such that the relative angle of the bucket 10 with respect to the target surface 60 is maintained if the distance between the bucket 10 and the target surface 60 is equal to or less than a preset second threshold value D2 set smaller than the first threshold value D1. As a result, control to maintain an angle of a work tool can be suitably started.

4 Claims, 13 Drawing Sheets

(51) Int. Cl.
*E02F 9/20* (2006.01)
*E02F 9/22* (2006.01)
*E02F 9/26* (2006.01)

(52) U.S. Cl.
CPC ..... *E02F 9/2041* (2013.01); *E02F 9/2203* (2013.01); *E02F 9/2271* (2013.01); *E02F 9/262* (2013.01); *E02F 9/2285* (2013.01); *E02F 9/2292* (2013.01); *E02F 9/2296* (2013.01)

(58) Field of Classification Search
CPC ..... E02F 9/262; E02F 9/2285; E02F 9/2292; E02F 9/2296; E02F 3/437; E02F 9/2282; E02F 3/43; E02F 9/121; E02F 9/22
See application file for complete search history.

(56) References Cited

U.S. PATENT DOCUMENTS

2017/0002540 A1* 1/2017 Fletcher ..... E02F 9/2029
2018/0274207 A1* 9/2018 Yokoo ..... E02F 3/437
2019/0078295 A1* 3/2019 Lamela ..... E02F 9/028
2019/0150350 A1* 5/2019 Engel ..... A01C 7/203
2019/0218749 A1 7/2019 Hiromatsu et al.
2019/0345697 A1 11/2019 Ishihara et al.
2020/0056354 A1* 2/2020 Oasa ..... E02F 9/2228
2020/0325650 A1* 10/2020 Tsukamoto ..... E02F 9/2235

FOREIGN PATENT DOCUMENTS

JP 2018-155027 A 10/2018
WO 2017/086488 A1 5/2017

OTHER PUBLICATIONS

International Preliminary Report on Patentability received in corresponding International Application No. PCT/JP2019/046852 dated Oct. 7, 2021.
International Search Report of PCT/JP2019/046852 dated Feb. 18, 2020.

* cited by examiner

WORK MACHINE ASSISTING OPERATION OF OPERATOR BY PERFORMING SEMI-AUTOMATIC CONTROL

TECHNICAL FIELD

The present invention relates to a work machine.

BACKGROUND ART

As a technology for enhancing working efficiency of a work machine (for example, hydraulic excavator) including a work device (for example, a front work device) driven by a hydraulic actuator, there is machine control (MC). The machine control (hereinafter referred to simply as MC) is a technology for assisting the operation of an operator by performing semi-automatic control to operate a work device according to predetermined conditions when an operation device is operated by the operator.

As a technology according to such MC, for example, Patent Document 1 discloses a controller for a construction machine provided with a work implement including at least a bucket, the controller including an operation amount data acquiring section that acquires operation amount data indicative of an operation amount of the work implement, an operation determination section that determines a non-operated state of the bucket based on the operation amount data; a bucket control determination section that determines whether or not bucket control conditions are satisfied based on the determination of the non-operated state, and a work implement control section that outputs a control signal for controlling the bucket such that the state of the work implement is maintained when it is determined that the bucket control conditions are satisfied.

PRIOR ART DOCUMENT

Patent Document

Patent Document 1: WO 2017/086488

SUMMARY OF THE INVENTION

Problem to Be Solved By the Invention

In the above-mentioned conventional technology, in a case of performing MC such as to move the bucket (work tool) of the front work device along a reference plane, when the distance between the bucket and a target excavation landform (hereinafter referred to as a target surface) is equal to or less than a preset threshold value and the arm is in a driven state, control is conducted to maintain the angle of the bucket relative to the target surface at a fixed angle, whereby, for example, a finishing work of the object to be excavated is assisted.

However, in the above-mentioned conventional technology, the threshold value set with respect to the distance between the bucket and the target surface as a condition for starting the control to maintain the angle of the bucket at a fixed angle is preliminarily determined. Therefore, depending on the manner of setting the threshold value, control may not be started when maintaining of the angle is required, or control may be started when maintaining of the angle is an obstacle. For example, in a finishing work such as to pile soil on the excavated surface and to press and consolidate by the bucket, the range in which the angle of the bucket would be maintained is increased if the threshold value is large.

Therefore, it is necessary to lower soil in a state of spacing the bucket largely from the excavated surface and to lower the bucket after the posture of the bucket is set into a posture of pressing and consolidating, so that an operation of giving a discomfort to the operator should be carried out, and working efficiency would be lowered. In addition, if the threshold value is small, deviation from the conditions for maintaining the angle of the bucket is liable to occur. Therefore, control to maintain the angle may not be started, or the presence and absence of control to maintain the angle may be switched unintentionally.

The present invention has been made in consideration of the foregoing, and it is an object of the present invention to provide a work machine capable of suitably starting control to maintain the angle of a work tool.

Means for Solving the Problem

The present patent application includes a plurality of means for solving the above-mentioned problem, one example thereof residing in a work machine including an articulated front work device configured by coupling, in a mutually rotatable manner, a plurality of driven members including a work tool provided at a tip end, a plurality of hydraulic actuators that respectively drive the plurality of driven members on the basis of an operation signal, an operation device that outputs the operation signal to, of the plurality of hydraulic actuators, a hydraulic actuator desired by an operator, a posture sensor that detects respective postures of the plurality of driven members of the front work device, and a controller that performs area limiting control of outputting the operation signal to at least one hydraulic actuator of the plurality of hydraulic actuators or correcting the operation signal, such that the front work device moves on a target surface set for an object of work by the front work device or an area on an upper side of the target surface. The work machine further includes a grounding state sensor that detects a grounding state of the work tool on soil. The controller is configured to output or correct the operation signal such that a relative angle of the work tool with respect to the target surface is maintained if a distance between the work tool and the target surface is equal to or less than a preset first threshold value when it is determined, on the basis of a result of detection by the grounding state sensor, that the work tool is grounded on the soil, and the controller is configured to output or correct the operation signal such that the relative angle of the work tool with respect to the target surface is maintained if the distance between the work tool and the target surface is equal to or less than a preset second threshold value set smaller than the first threshold value when it is determined, on the basis of the result of detection by the grounding state sensor, that the work tool is not grounded on the soil.

Advantage of the Invention

According to the present invention, control to maintain the angle of a work tool can be suitably started.

MODES FOR CARRYING OUT THE INVENTION

Figure 1:
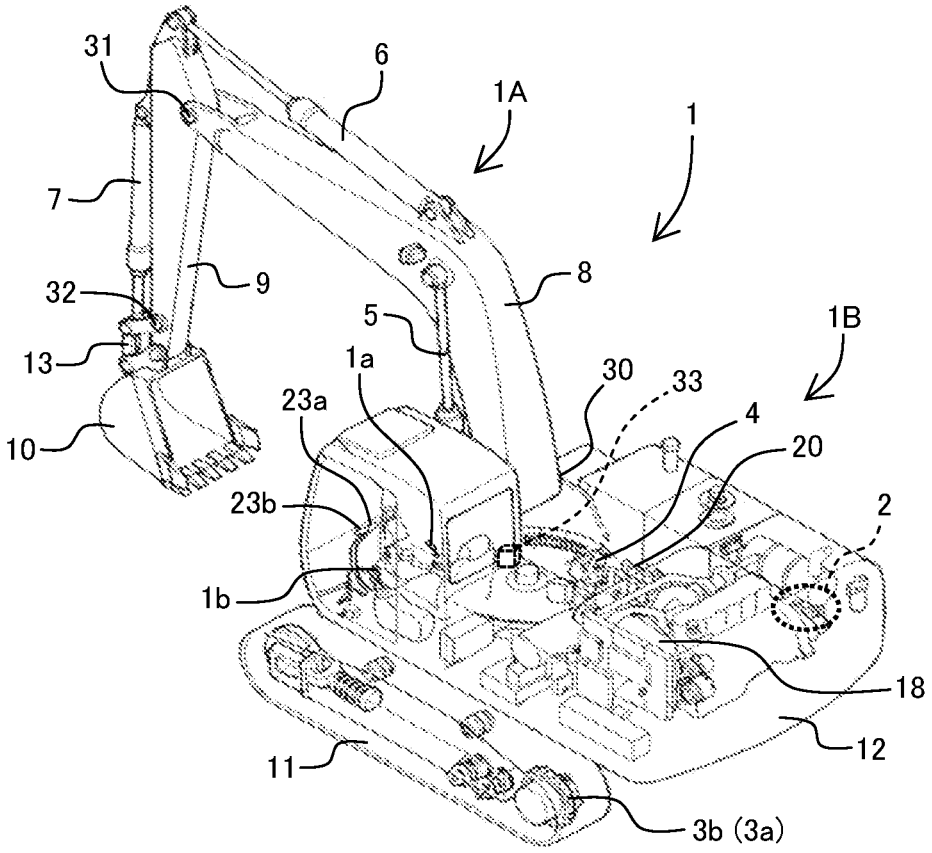
FIG. 1 is a diagram schematically depicting an external appearance of a hydraulic excavator as an example of work machine.

Embodiments of the present invention will be described below using the drawings. In the following description, a hydraulic excavator including a bucket as a work tool (attachment) at a tip end of a front work device is illustrated as an example of a work machine, but the present invention is applicable to a work machine including an attachment other than the bucket. In addition, the present invention is applicable to other work machines than the hydraulic excavator insofar as the work machine has an articulated front work device configured by coupling a plurality of driven members (attachment, arm, boom, etc.).

Besides, in the following description, with respect to the meaning of the term "on," "on the upper side of," or "on the lower side of" used with a term indicating a certain shape (for example, a target surface, a design surface, etc.), "on" means the "surface" of the certain shape, "on the upper side of" means "a position above the surface" of the certain shape, and "on the lower side of" means "a position below the surface" of the certain shape.

In addition, in the following description, when a plurality of the same component elements exist, an alphabet may be affixed to a reference character (numeral), but the plurality of component elements may be collectively represented by omitting the alphabet. In other words, for example, where two pumps 2*a* and 2*b* exist, they may be collectively represented as the pumps 2.

<Basic Configuration>

Figure 2:
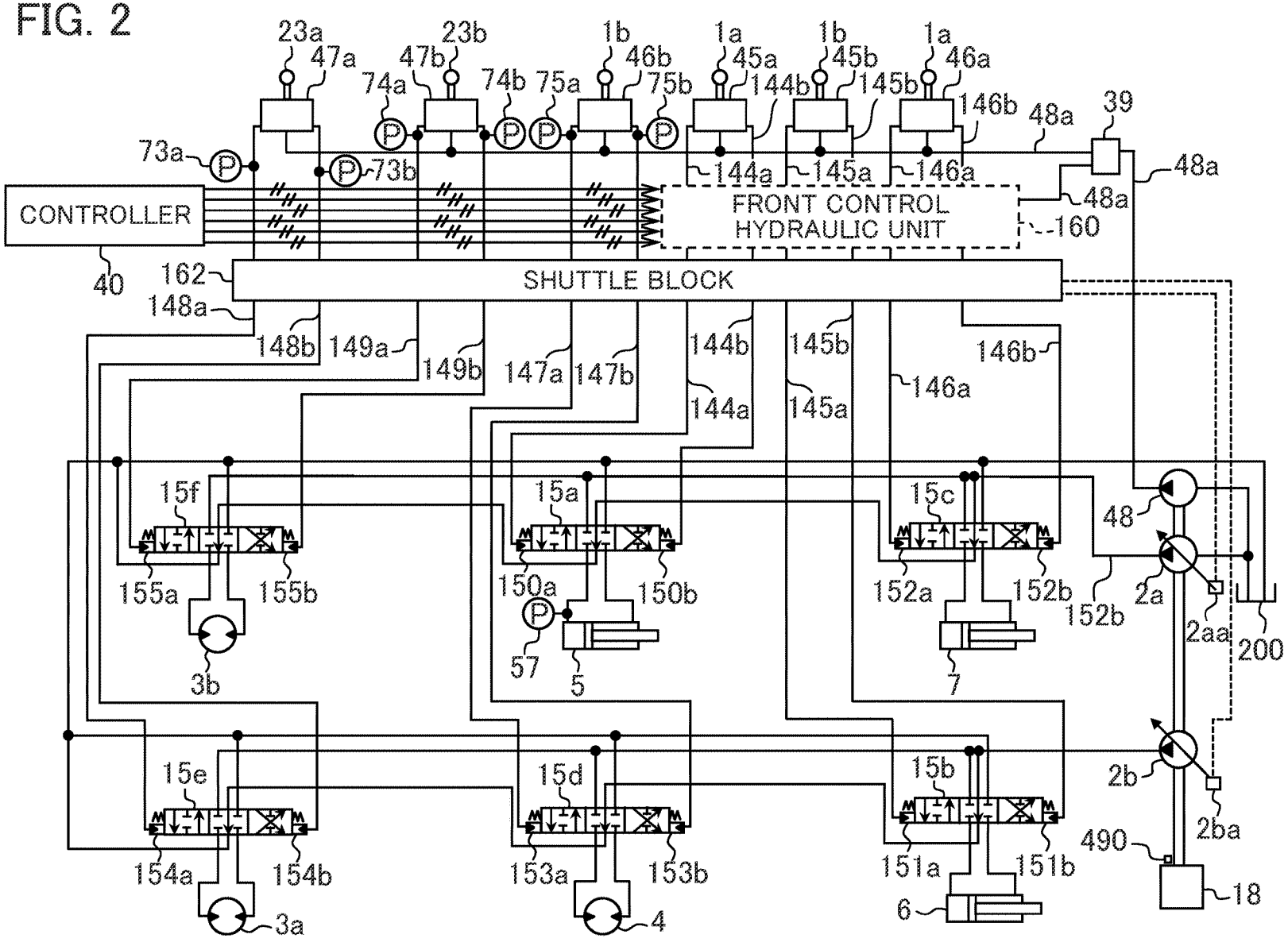
FIG. 2 is a diagram depicting, by extracting, a hydraulic circuit system of the hydraulic excavator together with a peripheral configuration including a controller.
Figure 3:
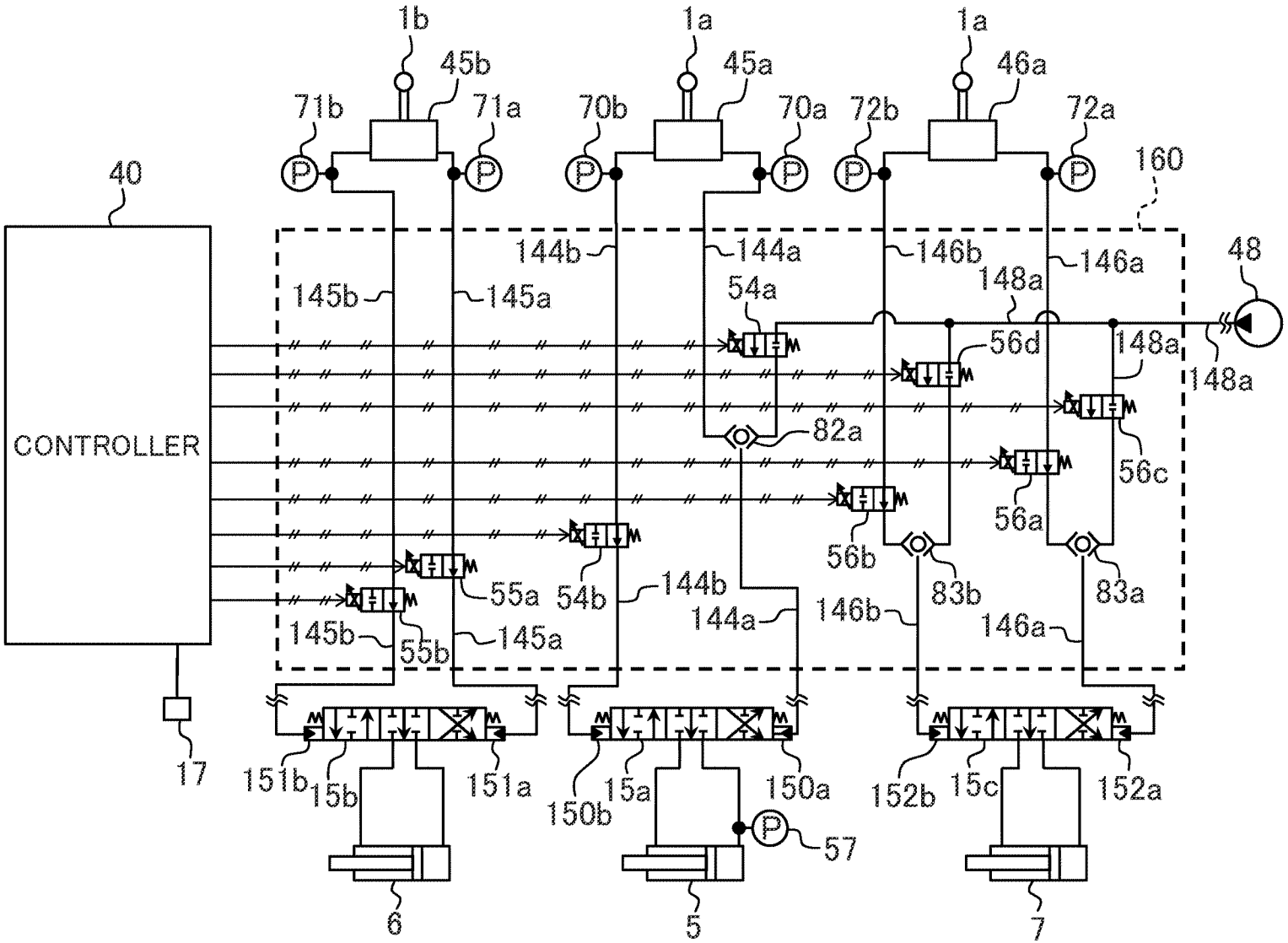
FIG. 3 is a diagram depicting the details of a front control hydraulic unit in FIG. 2.

FIG. 1 is a diagram schematically depicting an external appearance of a hydraulic excavator as an example of the work machine according to the present embodiment. In addition, FIG. 2 is a diagram depicting, by extracting, a hydraulic circuit system of the hydraulic excavator together with a peripheral configuration including a controller, and FIG. 3 is a diagram depicting the details of a front control hydraulic unit in FIG. 2.

In FIG. 1, the hydraulic excavator 1 includes an articulated front work device 1A and a main body 1B. The main body 1B of the hydraulic excavator 1 includes a lower track structure 11 traveling by left and right traveling hydraulic motors 3*a*, 3*b*, and an upper swing structure 12 mounted onto the lower track structure 11 and swinging by a swing hydraulic motor 4.

The front work device 1A is configured by coupling a plurality of driven members (a boom 8, an arm 9, and a bucket 10) respectively rotated in the perpendicular direction. A base end of the boom 8 is rotatably supported on a front portion of the upper swing structure 12 through a boom pin. The arm 9 is rotatably coupled to a tip end of the boom 8 through an arm pin, and the bucket 10 is rotatably coupled to a tip end of the arm 9 through a bucket pin. The boom 8 is driven by a boom cylinder 5, the arm 9 is driven by an arm cylinder 6, and the bucket 10 is driven by a bucket cylinder 7. Note that, in the following description, the boom cylinder 5, the arm cylinder 6, and the bucket cylinder 7 may be collectively referred to as hydraulic cylinders 5, 6, and 7 or hydraulic actuators 5, 6, and 7.

Figure 8:
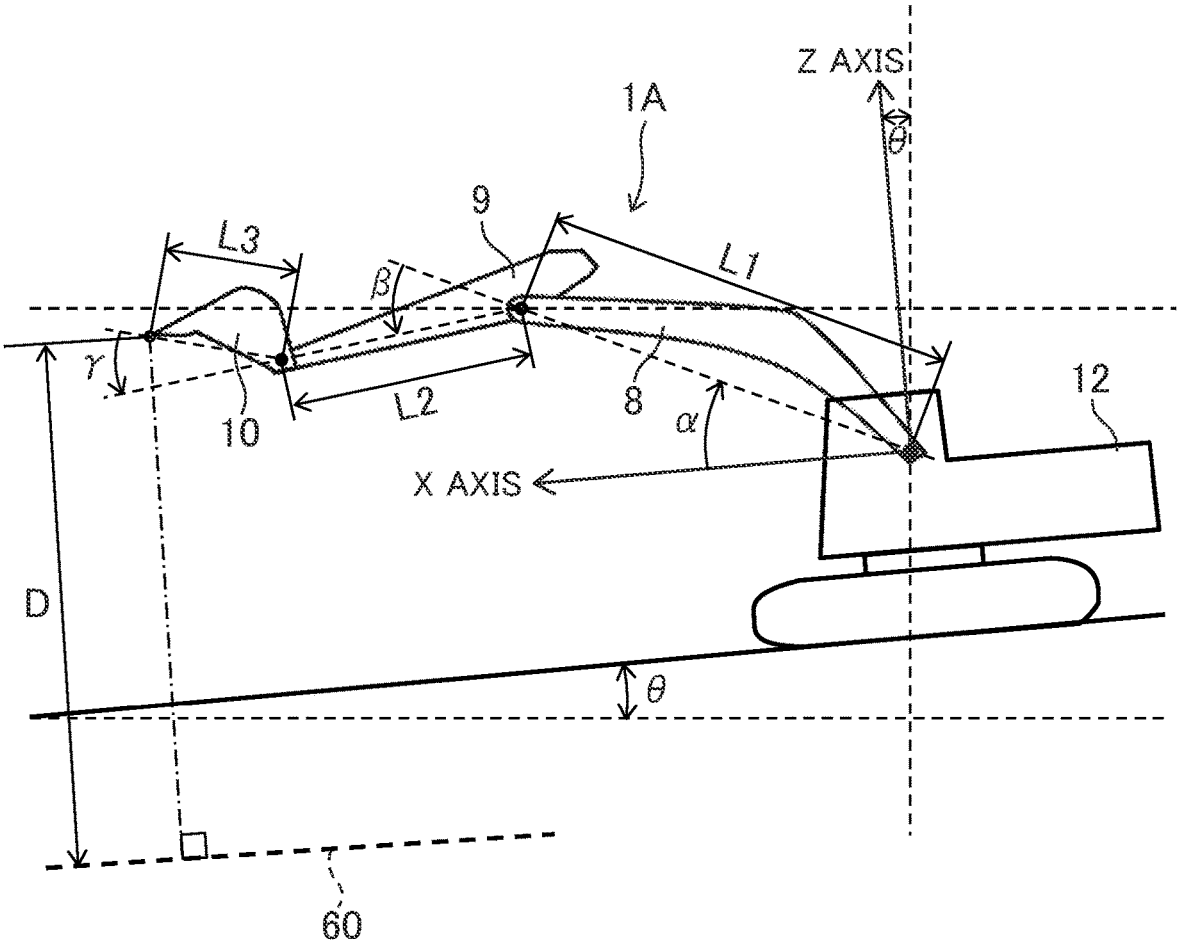
FIG. 8 is a diagram for explaining an excavator coordinate system set for the hydraulic excavator.

FIG. 8 is a diagram for explaining an excavator coordinate system set with respect to the hydraulic excavator.

As illustrated in FIG. 8, in the present embodiment, an excavator coordinate system (local coordinate system) is defined for the hydraulic excavator 1. The excavator coordinate system is an XY coordinate system defined in the manner of being fixed relative to the upper swing structure 12, and a machine body coordinate system is set in which a base end of the boom 8 rotatably supported by the upper swing structure 12 is an origin, and which has a Z axis passing through the origin in a direction along the swing axis of the upper swing structure 12 with the upper side as positive, and an X axis passing through the base end of the boom perpendicularly to the Z axis and in a direction along a plane on which the front work device 1A operates with the front side as positive.

In addition, the length of the boom 8 (the straight line distance between coupling parts at both ends) is defined as L1, the length of the arm 9 (the straight line distance between coupling parts at both ends) is defined as L2, the length of the bucket 10 (the straight line distance between a coupling part for the arm and the claw tip) is defined as L3, the angle formed between the boom 8 and the X axis (the relative angle between a straight line in the lengthwise direction and the X axis) is defined as rotational angle $\alpha$, the angle formed between the arm 9 and the boom 8 (the relative angle of a straight line in the lengthwise direction) is defined as rotational angle $\beta$, the angle formed between the bucket 10 and the arm 9 (the relative angle of a straight line in the lengthwise direction) is defined as rotational angle $\gamma$. As a result, the coordinates of the bucket claw tip position in the excavator coordinate system and the posture of the front work device 1A can be represented by L1, L2, L3, $\alpha$, $\beta$, and $\gamma$.

Further, the inclination in the front-rear direction of the main body 1B of the hydraulic excavator 1 relative to the horizontal plane is an angle $\theta$, and the distance between the claw tip of the bucket 10 of the front work device 1A and the target surface 60 is D. Note that the target surface 60 is a target surface to be excavated which is set based on, for example, design information at the construction site as a target of an excavation work.

In the front work device 1A, a boom angle sensor 30 is attached to the boom pin, an arm angle sensor 31 is attached to the arm pin, and a bucket angle sensor 32 is attached to a bucket link 13, as posture sensors for measuring the rotational angles $\alpha$, $\beta$, and $\gamma$ of the boom 8, the arm 9, and the bucket 10. In addition, a machine body inclination angle sensor 33 for detecting the inclination angle $\theta$ of the upper swing structure 12 (the main body 1B of the hydraulic excavator 1) relative to a reference surface (for example, a horizontal surface) is attached to the upper swing structure 12. Note that, as the angle sensors 30, 31, and 32, those detecting the relative angles at the coupling parts of the plurality of driven members 8, 9, and 10 are illustrated as examples in the description, they may be replaced by inertial measurement units (IMU) for respectively detecting the relative angles of the plurality of driven members 8, 9, and 10 relative to a reference surface (for example, a horizontal surface).

An operation device 47*a* (FIG. 2) having a track right lever 23*a* (FIG. 1) and for operating a track right hydraulic motor 3*a* (lower track structure 11), an operation device 47*b* (FIG. 2) having a track left lever 23*b* (FIG. 1) and for operating a track left hydraulic motor 3*b* (lower track structure 11), operation devices 45*a* and 46*a* (FIG. 2) sharing an operation right lever 1*a* (FIG. 1) and for operating the boom cylinder 5 (boom 8) and the bucket cylinder 7 (bucket 10), and operation devices 45*b* and 46*b* (FIG. 2) sharing an operation left lever 1*b* (FIG. 1) and for operating the arm cylinder 6 (arm 9) and the swing hydraulic motor 4 (upper swing structure 12) are disposed in a cabin provided on the upper swing structure 12. Hereinbelow, the track right lever 23*a*, the track left lever 23*b*, the operation right lever 1*a*, and the operation left lever 1*b* may be generically referred to as operation levers 1 and 23.

In addition, a display device (for example, a liquid crystal display) 53 capable of displaying the positional relation between the target surface 60 and the front work device 1A, a control selection device 97 for alternatively selecting permission or inhibition (ON or OFF) of bucket angle control (also referred to as work tool angle control) by machine control (hereinafter referred to as MC), and a target surface setting device 51 as an interface capable of inputting information concerning the target surface 60 (inclusive of position information and inclination angle information concerning each target surface) are disposed in the cabin.

The control selection device 97 is, for example, provided at an upper end portion of a front surface of the operation lever 1*a* which is in the shape of a joy stick, and is depressed by a thumb of the operator grasping the operation lever 1*a*. Besides, the control selection device 97 is, for example, a momentary switch, and each time it is depressed, validity (ON) and invalidity (OFF) of the bucket angle control (work tool angle control) is switched over. Note that the location where the control selection device 97 is disposed is not limited to the operation lever 1*a* (1*b*), but the control selection device 97 may be provided at other positions. In addition, the control selection device 97 may not necessarily be configured by hardware. For example, the display device 53 may be made as a touch panel, and the control selection device 97 may be configured by a graphical user interface (GUI) displayed on a display screen of the touch panel.

The target surface setting device 51 is connected to an external terminal (not illustrated) in which three-dimensional data of the target surface defined on a global coordinate system (absolute coordinate systems) are stored, and setting of the target surface 60 is conducted based on information from the external terminal. Note that the inputting of the target surface 60 through the target surface setting device 51 may be manually performed by the operator.

As depicted in FIG. 2, the engine 18 as a prime mover mounted on the upper swing structure 12 drives the hydraulic pumps 2*a* and 2*b* and a pilot pump 48. The hydraulic pumps 2*a* and 2*b* are variable displacement pumps of which the capacity is controlled by regulators 2*aa* and 2*ba*, whereas the pilot pump 48 is a fixed displacement pump. The hydraulic pumps 2 and the pilot pump 48 sucks a hydraulic operating oil from a hydraulic operating oil tank 200.

Shuttle blocks 162 are provided at intermediate portions of pilot lines 144, 145, 146, 147, 148, and 149 that transmit hydraulic signals outputted as operation signals from the operation devices 45, 46, and 47. The hydraulic signals outputted from the operation devices 45, 46, and 47 are inputted also to the regulators 2*aa* and 2*ba* through the shuttle blocks 162. The shuttle block 162 include a plurality of shuttle valves and the like for selectively extracting the hydraulic signals of the pilot lines 144, 145, 146, 147, 148, and 149, but description of detailed configuration thereof is omitted. The hydraulic signals from the operation devices 45, 46, and 47 are inputted to the regulators 2*aa* and 2*ba* through the shuttle blocks 162, and the delivery flow rates of the hydraulic pumps 2*a* and 2*b* are controlled according to the hydraulic signals.

A pump line 48*a* as a delivery line of the pilot pump 48 passes through a lock valve 39 and is thereafter branched into a plurality of lines, which are connected to respective valves in the operation devices 45, 46, and 47 and a front control hydraulic unit 160. The lock valve 39 is, for example, a solenoid selector valve, and its solenoid driving section is electrically connected to a position sensor of a gate lock lever (not illustrated) disposed in the cabin (FIG. 1). The position of the gate lock lever is detected by the position sensor, and a signal according to the position of the gate lock lever is inputted from the position sensor to the lock valve 39. When the position of the gate lock lever is at a lock position, the lock valve 39 is closed and the pump line 48*a* is shielded, whereas, when the position of the gate lock lever is at an unlock position, the lock valve 39 is opened and the pump line 48*a* is opened. In other words, in a state in which the gate lock lever is operated into the lock position and the pump line 48*a* is shielded, operations by the operation devices 45, 46, and 47 are invalidated, and operations such as swing and excavation are inhibited.

The operation devices 45, 46, and 47 are of a hydraulic pilot system, and, based on a hydraulic oil delivered from the pilot pump 48, pilot pressures (which may be referred to as operation pressures) according to the operation amounts (for example, lever strokes) and operation directions of the operation levers 1 and 23 operated by the operator are generated as hydraulic signals. The pilot pressures (hydraulic signals) generated in this way are supplied to hydraulic driving sections 150*a* to 155*b* of the corresponding flow control valves 15*a* to 15*f* (see FIGS. 2 and 3) through pilot lines 144*a* to 149*b* (see FIG. 3), and are utilized as operation signals for driving the flow control valves 15*a* to 15*f*.

The hydraulic oils delivered from the hydraulic pumps 2 are supplied to the track right hydraulic motor 3*a*, the track left hydraulic motor 3*b*, the swing hydraulic motor 4, the boom cylinder 5, the arm cylinder 6, and the bucket cylinder 7 through the flow control valves 15*a*, 15*b*, 15*c*, 15*d*, 15*e*, and 15*f* (see FIG. 2). With the boom cylinder 5, the arm cylinder 6, and the bucket cylinder 7 contracted or extended by the hydraulic oil supplied from the hydraulic pumps 2 through the flow control valves 15*a*, 15*b*, and 15*c*, the boom 8, the arm 9, and the bucket 10 are respectively rotated and the position and the posture of the bucket 10 are changed. In addition, with the swing hydraulic motor 4 rotated by the hydraulic oil supplied from the hydraulic pump 2 through the flow control valve 15*d*, the upper swing structure 12 swings relative to the lower track structure 11. Besides, with the track right hydraulic motor 3*a* and the track left hydraulic motor 3*b* rotated by the hydraulic oil supplied from the hydraulic pumps 2 through the flow control valves 15*e* and 15*f*, the lower track structure 11 travels. The boom cylinder 5 is provided with a pressure sensor 57 for detecting the pressure on the bottom side of the boom cylinder 5, as a bucket grounding state sensor for detecting whether or not the bucket 10 is grounded on soil. Note that it is sufficient for the grounding state sensor to be able to detect whether or not the bucket 10 as a work tool is grounded on soil, and, for example, a configuration in which whether or not the bucket 10 is grounded on soil is determined from a video image acquired by a camera device having a stereo camera may be adopted.

<Front Control Hydraulic Unit 160>

As depicted in FIG. 3, the front control hydraulic unit 160 includes pressure sensors 70*a* and 70*b* as operator operation posture sensors that are provided in pilot line 144*a* and 144*b* of the operation device 45*a* for the boom 8 and detect a pilot pressure (first control signal) as an operation amount of the operation lever 1*a*, a solenoid proportional valve 54*a* that has a primary port side connected to the pilot pump 48 through the pump line 48*a*, reduces the pilot pressure from the pilot pump 48, and outputs the reduced pilot pressure, a shuttle valve 82*a* that is connected to the pilot line 144*a* of the operation device 45*a* for the boom 8 and the secondary port side of the solenoid proportional valve 54*a*, selects the high pressure side of the pilot pressure in the pilot line 144*a* and a control pressure (second control signal) outputted from the solenoid proportional valve 54*a*, and introduces the selected high pressure side to the hydraulic driving section 150*a* of the flow control valve 15*a*, and a solenoid proportional valve 54*b* that is disposed in the pilot line 144*b* of the operation device 45*a* for the boom 8, reduces the pilot pressure (first control signal) in the pilot line 144*b*, based on a control signal from the controller 40, and outputs the reduced pilot pressure (first control signal).

In addition, the front control hydraulic unit 160 includes pressure sensors 71*a* and 71*b* as operator operation posture sensors that are disposed in pilot lines 145*a* and 145*b* for the arm 9, detect the pilot pressure (first control signal) as an operation amount of the operation lever 1*b*, and output the pilot pressure to the controller 40, a solenoid proportional valve 55*b* that is disposed in the pilot line 145*b*, reduces the pilot pressure (first control signal), based on the control signal from the controller 40, and outputs the reduced pilot pressure (first control signal), and a solenoid proportional valve 55*a* that is disposed in the pilot line 145*a*, reduces the pilot pressure (first control signal) in the pilot line 145*a*, based on the control signal from the controller 40, and outputs the reduced pilot pressure (first control signal).

Besides, the front control hydraulic unit 160 includes pressure sensors 72*a* and 72*b* as operator operation posture sensors that are disposed in pilot lines 146*a* and 146*b* for the bucket 10, detect the pilot pressure (first control signal) as the operation amount of the operation lever 1*a*, and output the pilot pressure to the controller 40, solenoid proportional valves 56*a* and 56*b* that reduces the pilot pressure (first control signal), based on the control signal from the controller 40, and outputs the reduced pilot pressure (first control signal), solenoid proportional valves 56*c* and 56*d* that have the primary port side connected to the pilot pump 48, reduces the pilot pressure from the pilot pump 48, and outputs the reduced pilot pressure, and shuttle valves 83*a* and 83*b* that select the high pressure side of the pilot pressures in the pilot lines 146*a* and 146*b* and control pressures outputted from the solenoid proportional valves 56*c* and 56*d* and introduce the selected high pressure side to hydraulic driving sections 152*a* and 152*b* of the flow control valve 15*c*. Note that, in FIG. 3, connection lines between the pressure sensors 70, 71, and 72 and the controller 40 are omitted for want of space.

The solenoid proportional valves 54*b*, 55*a*, 55*b*, 56*a*, and 56*b* have its maximum opening degrees when not energized, and the opening degrees are reduced as the current as the control signal from the controller 40 is increased. On the other hand, the solenoid proportional valves 54*a*, 56*c*, and 56*d* have zero opening degrees, have opening degrees when energized, and the opening degrees are increased as the current (control signal) from the controller 40 is increased. In this way, the opening degree of each of the solenoid proportional valves 54, 55, and 56 is according to the control signal from the controller 40.

Hereinafter, in the present embodiment, the pilot pressures generated by operations of the operation devices 45*a*, 45*b*, and 46*a*, of control signals for the flow control valves 15*a* to 15*c*, will be referred to as "first control signals." In addition, the pilot pressures generated by driving the solenoid proportional valves 54*b*, 55*a*, 55*b*, 56*a*, and 56*b* by the controller 40 to correct (reduce) the first control signal and the pilot pressures newly generated separately from the first control signal by driving the solenoid proportional valves 54*a*, 56*c*, and 56*d* by the controller 40, of the control signals for the flow control valves 15*a* to 15*c*, will be referred to as "second control signals."

<Controller 40>

Figure 4:
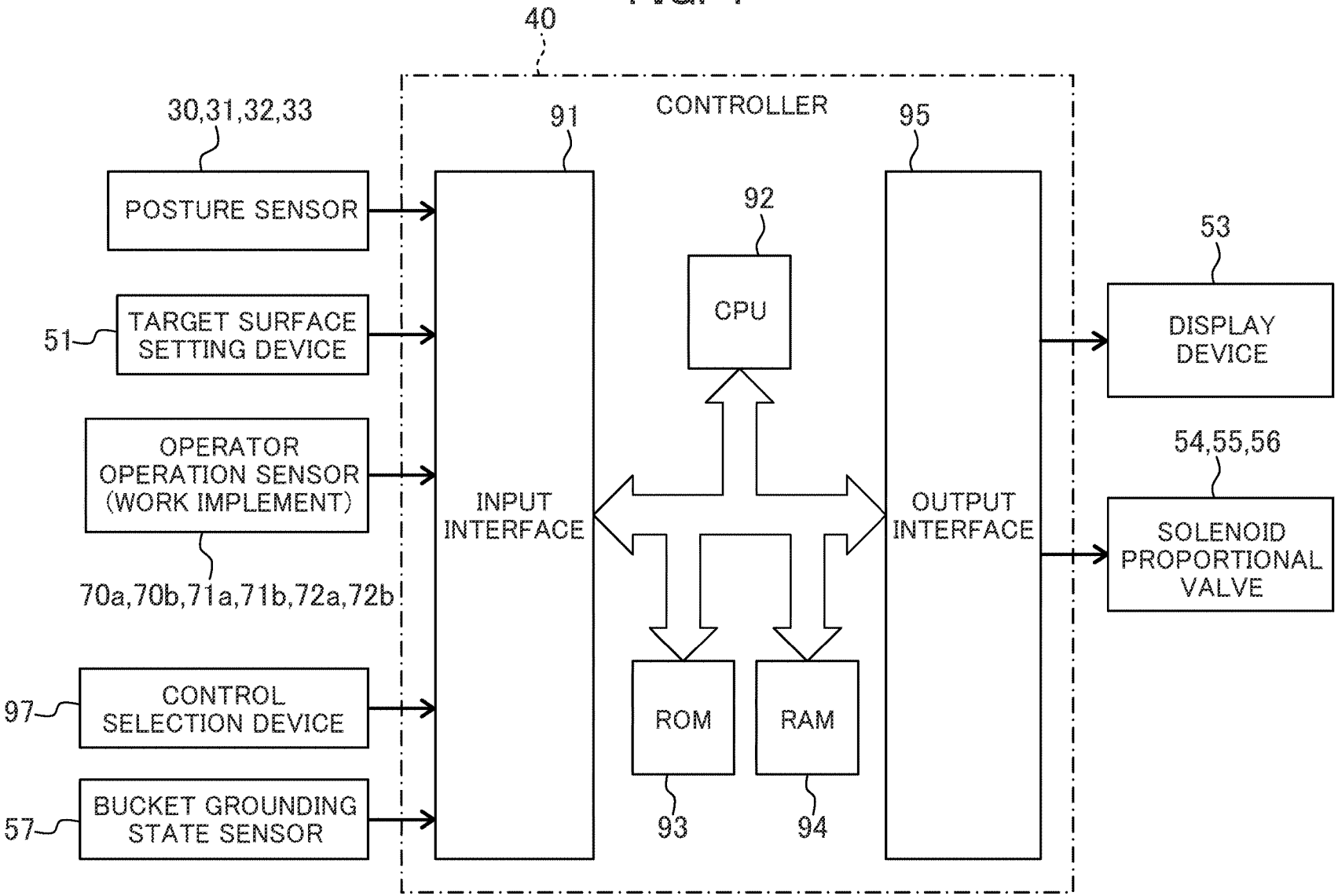
FIG. 4 is a hardware configuration diagram of the controller.

FIG. 4 is a hardware configuration diagram of the controller.

In FIG. 4, the controller 40 has an input interface 91, a central processing unit (CPU) 92 as a processor, a read only memory (ROM) 93 and a random access memory (RAM) 94 as storage devices, and an output interface 95. The input interface 91 receives as inputs signals from the posture sensors (the boom angle sensor 30, the arm angle sensor 31, the bucket angle sensor 32, and the machine body inclination angle sensor 33), a signal from the target surface setting device 51, signals from the operator operation posture sensors (the pressure sensors 70*a*, 70*b*, 71*a*, 71*b*, 72*a*, and 72*b*) and the control selection device 97, and a signal from the bucket grounding state sensor (the pressure sensor 57), and performs A/D conversion. The ROM 93 is a storage medium in which a control program for executing a flow chart described later and various kinds of information necessary for executing the flow chart and the like are stored. The CPU 92 applies predetermined arithmetic processing to the signals taken in from the input interface 91 and the memories 93 and 94 according to the control program stored in the ROM 93. The output interface 95 generates output signals according to the result of the arithmetic processing in the CPU 92 and outputs the signals to the display device 53 and the solenoid proportional valves 54, 55, and 56 to thereby drive and control the hydraulic actuators 3*a*, 3*b*, and 3*c*, and to display images of the main body 1B and the bucket 10 of the hydraulic excavator 1, the target surface 60, and the like on a display screen of the display device 53. Note that the controller 40 in FIG. 4 is exemplified by one including semiconductor memories of the ROM 93 and the RAM 94 as storage devices, but the storage devices may be replaced by any device that has a storage function, for example, magnetic storage devices such as hard disk drives.

The controller 40 in the present embodiment performs, as machine control (MC), a processing of controlling the front work device 1A based on predetermined conditions when the operation devices 45 and 46 are operated by the operator. The MC in the present embodiment may be referred to as "semi-automatic control" in which the operation of the front work device 1A is controlled by a computer only when the operation devices 45 and 46 are operated, as contrasted to "automatic control" in which the operation of the front work device 1A is controlled when the operation devices 45 and 46 are not operated.

As the MC of the front work device 1A, when an excavation operation (specifically, a designation of at least one of arm crowding, bucket crowding, and bucket dumping) is inputted through the operation devices 45*b* and 46*a*, what is called area limiting control is performed. In the area limiting control, a control signal for forcibly operating at least one of the hydraulic actuators 5, 6, and 7 (for example, extending the boom cylinder 5 to forcibly raise the boom) such that the position of the tip end of the front work device 1A is maintained on the target surface 60 and in an area on the upper side thereof, based on the positional relation between the target surface 60 and the tip end of the front work device 1A (in the present embodiment, the claw tip of the bucket 10), is outputted to the relevant flow control valve 15*a*, 15*b*, and 15*c*.

Since the claw tip of the bucket 10 is prevented from entering the lower side of the target surface 60 by such MC, it is possible to excavate along the target surface 60, irrespectively of the extent of the operator's workmanship. Note that, in the present embodiment, the control point of the front work device 1A at the time of MC is set at the claw tip of the bucket 10 of the hydraulic excavator (the tip end of the front work device 1A), but the control point may be changed to other point than the bucket claw tip insofar as the other point is a point of a tip end portion of the front work device 1A. In other words, the control point may be set at, for example, a bottom surface of the bucket 10, or an outermost part of the bucket link 13.

In the front control hydraulic unit 160, when a control signal is outputted from the controller 40 to drive the solenoid proportional valve 54*a*, 56*c*, or 56*d*, a pilot pressure (second control signal) can be generated even when an operator operation of the corresponding operation device 45*a* or 46*a* is absent, and, therefore, a boom raising operation, a bucket crowding operation, and a bucket dumping operation can be forcibly generated. In addition, when the solenoid proportional valve 54*b*, 55*a*, 55*b*, or 56*b* is driven by the controller 40 similarly to this, a pilot pressure (second control signal) obtained by reducing a pilot pressure (first control signal) generated by an operator operation of the operation device 45*a*, 45*b*, or 46*a* can be generated, so that the velocity of a boom lowering operation, an arm crowding/dumping operation, and a bucket crowding/dumping operation can be forcibly reduced from the value by the operator operation.

The second control signal is generated when the velocity vector of the control point of the front work device 1A generated by the first control signal is contradictory to predetermined conditions, and is generated as a control signal for generating a velocity vector of a control point of the front work device 1A that is not contradictory to the predetermined conditions. Note that, when the first control signal is generated for the hydraulic driving section on one side in the same flow control valve 15*a* to 15*c* and the second control signal is generated for the hydraulic driving section on the other side, the second control signal is made to act on the hydraulic driving section on a priority basis, the first control signal is shielded by a solenoid proportional valve, and the second control signal is inputted to the hydraulic driving section on the other side. Therefore, the flow control valve 15*a*, 15*b*, or 15*c* for which the second control signal is calculated is controlled based on the second control signal, flow control valve 15*a*, 15*b*, or 15*c* for which the second control signal is not calculated is controlled based on the first control signal, and flow control valve 15*a*, 15*b*, or 15*c* for which neither the first control signal nor the second control signal is generated is not controlled (driven). When the first control signal and the second control signal are defined as above, MC can be said to be control of the flow control valves 15*a* to 15*c* based on the second control signal.

Figure 5:
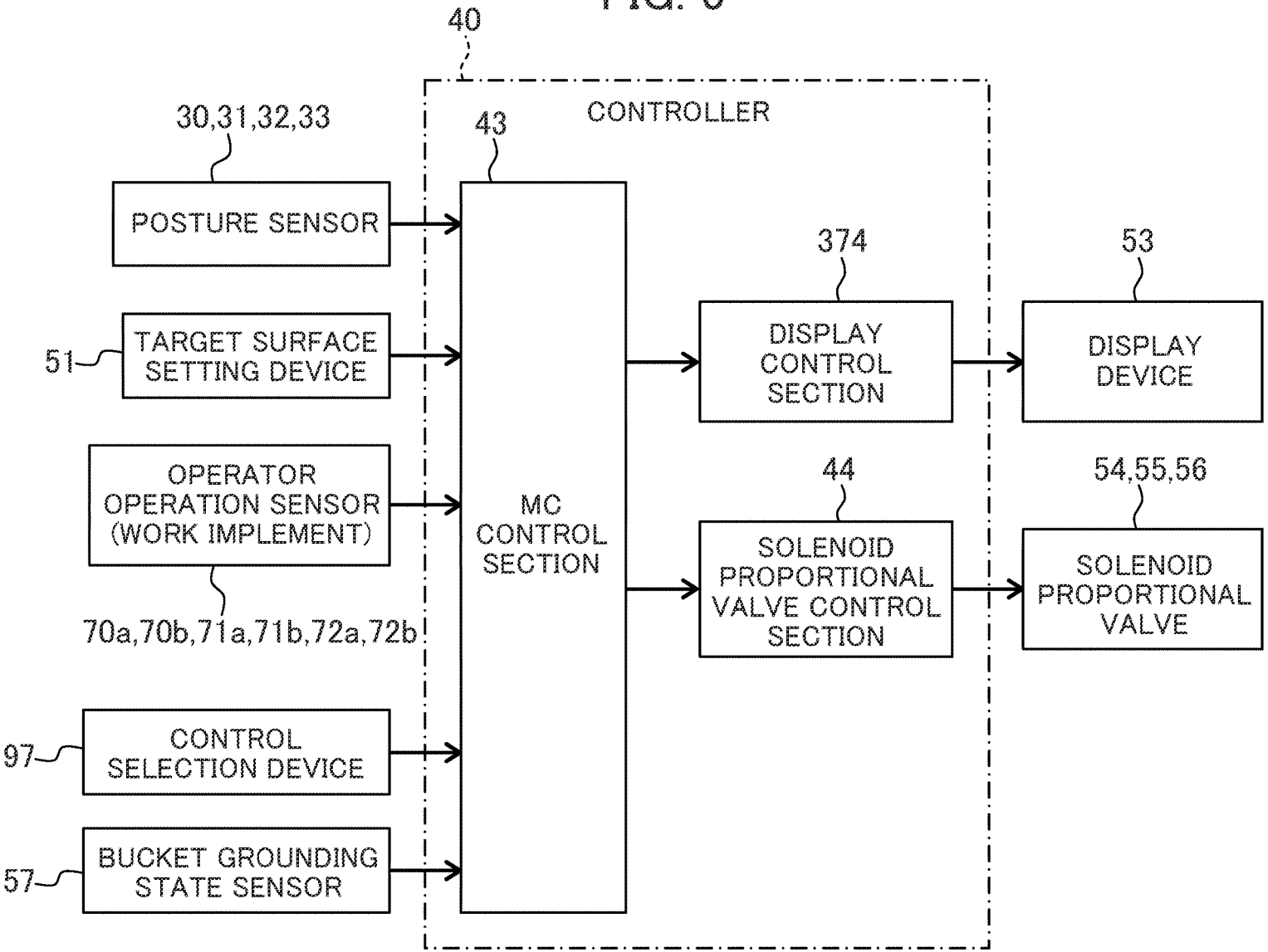
FIG. 5 is a functional block diagram depicting processing functions of the controller.

FIG. 5 is a functional block diagram depicting the processing functions of the controller. In addition, FIG. 6 is a functional block diagram depicting the details of the processing functions of the MC control section in FIG. 5.

As illustrated in FIG. 5, the controller 40 includes an MC control section 43, a solenoid proportional valve control section 44, and a display control section 374.

The display control section 374 is a section that controls the display device 53 based on the work device posture and the target surface outputted from the MC control section 43. The display control section 374 includes a display ROM in which a number of pieces of display-concerned data including images and icons of the front work device 1A are stored. The display control section 374 reads a predetermined program based on a flag contained in the input information and controls the display on the display device 53.

Figure 6:
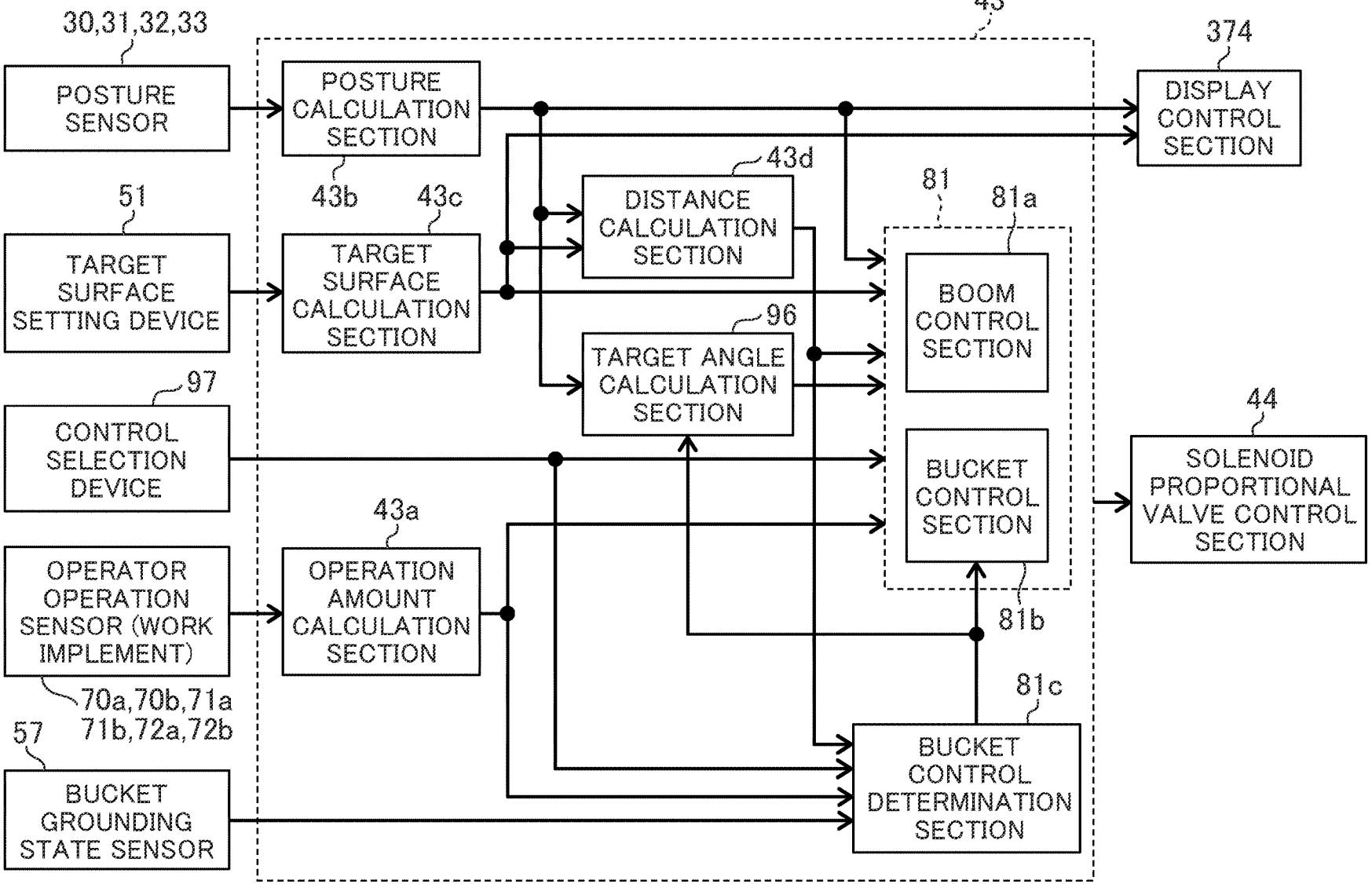
FIG. 6 is a functional block diagram depicting the details of processing functions of an MC control section in FIG. 5.

As depicted in FIG. 6, the MC control section 43 includes an operation amount calculation section 43*a*, a posture calculation section 43*b*, a target surface calculation section 43*c*, a boom control section 81*a*, and a bucket control section 81*b*.

The operation amount calculation section 43*a* calculates operation amounts of the operation devices 45*a*, 45*b*, and 46*a* (operation levers 1*a* and 1*b*) based on inputs from the operator operation posture sensors (pressure sensors 70, 71, and 72). The operation amount calculation section 43*a* calculates the operation amounts of the operation devices 45*a*, 45*b*, and 46*a* from detection values by the pressure sensors 70, 71, and 72. Note that the calculation of the operation amounts by the pressure sensors 70, 71, and 72 illustrated in the present embodiment is merely an example, and, for example, the operation amount of the operation lever may be detected by a position sensor (for example, rotary encoder) detecting the rotational displacement of the operation lever of each of the operation devices 45*a*, 45*b*, and 46*a*.

The posture calculation section 43*b* calculates the posture of the front work device 1A in a local coordinate system, and the position of the claw tip of the bucket 10, based on information from a work device posture sensor 50.

The target surface calculation section 43*c* calculates position information of the target surface 60 based on information from the target surface setting device 51 and stores the position information in the ROM 93. In the present embodiment, as depicted in FIG. 8, a sectional shape upon cutting the three-dimensional target surface by a plane of movement of the front work device 1A (operating plane of the work implement) is utilized as the target surface 60 (two-dimensional target surface).

Note that, while a case where the target surface 60 is one is depicted as an example in FIG. 8, there are cases where a plurality of target surfaces are present. In the cases where there are a plurality of target surfaces, for example, a method of setting the target surface the nearest to the front work device 1A as the target surface, a method of setting the target surface located on the lower side of the bucket claw tip as the target surface, a method of setting a target surface selected as desired as the target surface, and the like may be adopted.

The distance calculation section 43*d* calculates a distance D (see FIG. 8) from the bucket tip to the target surface 60 as an object of control, based on the position (coordinates) of the claw tip of the bucket 10 and the distance of straight lines including the target surface 60 stored in the ROM 93.

The target angle calculation section 96 calculates a target angle of the inclination angle bucket angle γ (hereinafter also referred to "target bucket angle γTGT") of the bucket claw tip relative to the target surface 60. For setting of the target bucket angle γTGT, the bucket angle γ at the time when bucket control is started at a bucket control determination section 81*c* is set.

The boom control section 81*a* and the bucket control section 81*b* constitute an actuator control section 81 that controls at least one of the plurality of hydraulic actuators 5, 6, and 7 according to preset conditions when the operation devices 45*a*, 45*b*, and 46*a* are operated. The actuator control section 81 calculates target pilot pressures for the flow control valves 15*a*, 15*b*, and 15*c* of the hydraulic cylinders 5, 6, and 7 and outputs the thus calculated target pilot pressures to the solenoid proportional valve control section 44.

The boom control section 81*a* is a section that performs MC for controlling the operation of the boom cylinder 5 (boom 8) such that the claw tip (control point) of the bucket 10 is located on the target surface 60 or on the upper side thereof, based on the position of the target surface 60, the posture of the front work device 1A and the position of the claw tip of the bucket 10, and operation amounts of the operation devices 45*a*, 45*b*, and 46*a*, when the operation devices 45*a*, 45*b*, and 46*a* are operated. The boom control section 81*a* calculates a target pilot pressure for the flow control valve 15*a* of the boom cylinder 5.

The bucket control section 81*b* is a section for performing bucket angle control by MC when the operation devices 45*a*, 45*b*, and 46*a* are operated. While the detailed contents of control by the bucket control section 81*b* will be described later, MC (bucket angle control) of controlling the operation of the bucket cylinder 7 (bucket 10) such that the inclination angle γ of the bucket claw tip relative to the arm is the target bucket angle γTGT set by the target angle calculation section 96, is performed when it is determined by the bucket control determination section 81*c* that the bucket is to be automatically controlled. The bucket control section 81*b* calculates a target pilot pressure for the flow control valve 15*c* of the bucket cylinder 7.

The solenoid proportional valve control section 44 calculates commands for the solenoid proportional valves 54 to 56, based on target pilot pressures for the flow control valves 15*a*, 15*b*, and 15*c* that are outputted from the actuator control section 81. Note that, when the pilot pressure (first control signal) based on the operator operation and the target pilot pressure calculated by the actuator control section 81 coincide with each other, the current value (command value) to the relevant solenoid proportional valve 54 to 56 becomes zero, and the operation of the relevant solenoid proportional valve 54 to 56 is not performed.

<Boom Control According to MC (Boom Control Section 81*a*)>

Here, details of a boom control according to MC will be described.

Figure 7:
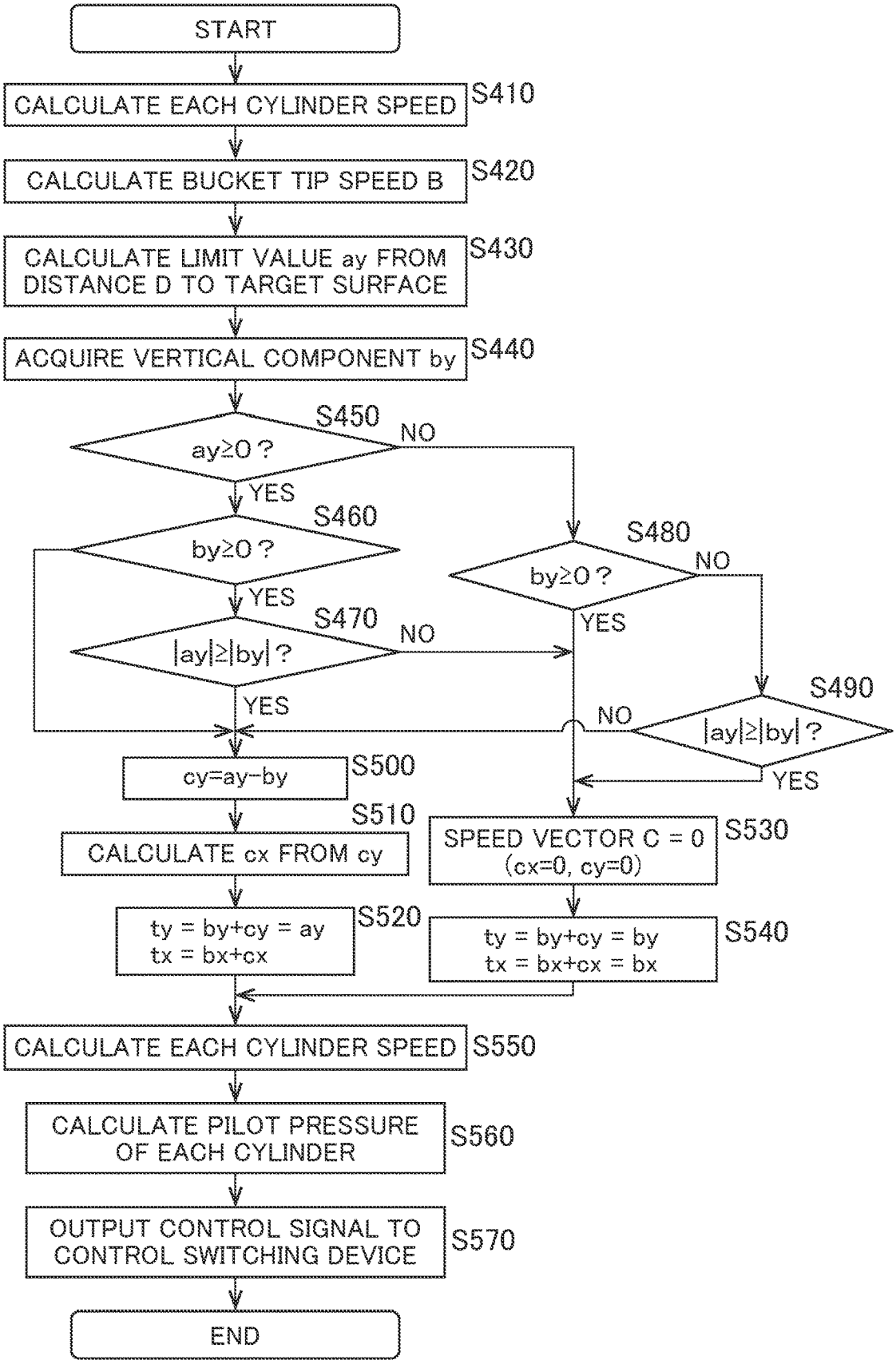
FIG. 7 is a flow chart depicting the contents of processing with respect to a boom in the MC by the controller.
Figure 9:
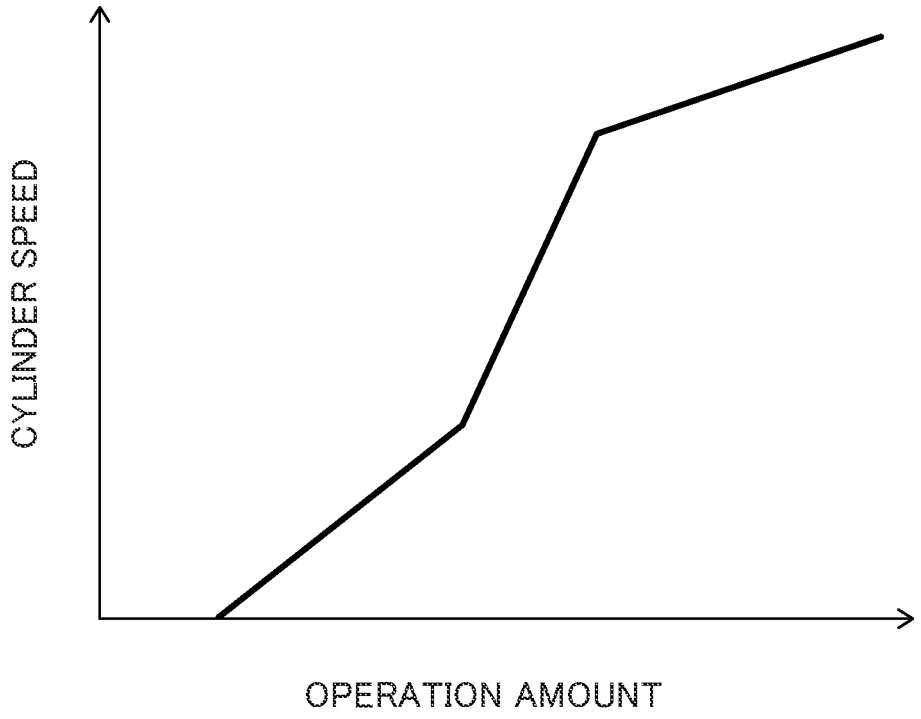
FIG. 9 is a diagram depicting an example of a setting table of cylinder velocity relative to an operation amount.
Figure 10:
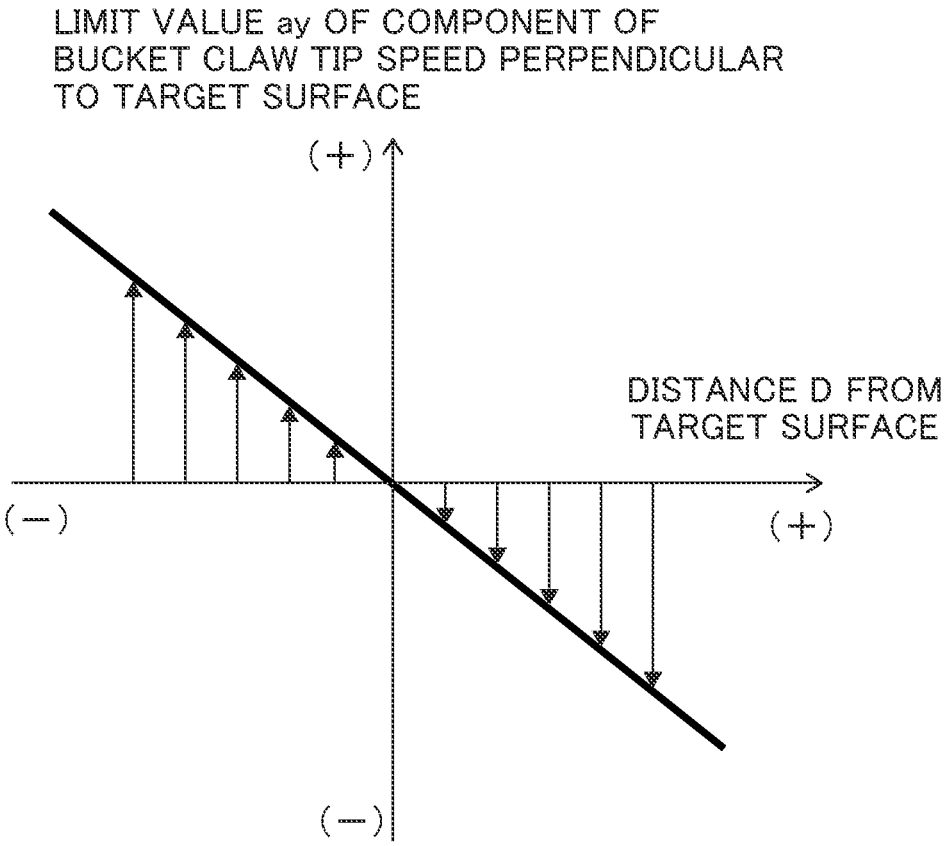
FIG. 10 is a diagram depicting the relation between a limit value of a perpendicular component of bucket claw tip velocity and distance.
Figure 11:
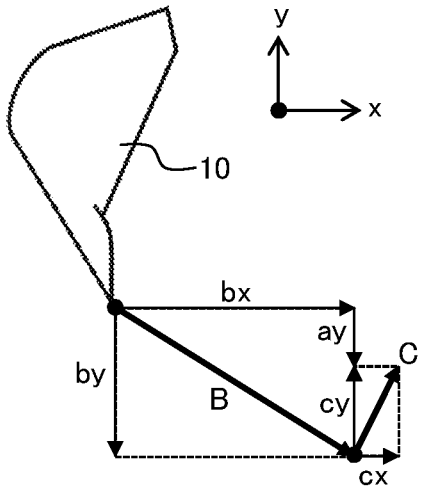
FIG. 11 is a diagram depicting an example of velocity components of a bucket.

FIG. 7 is a flow chart depicting the contents of processing with respect to the boom of MC by the controller. In addition, FIG. 9 is a diagram depicting an example of a setting table for cylinder velocity relative to the operation amount, FIG. 10 is a diagram depicting the relation between a limit value of a perpendicular component of bucket claw tip velocity and distance, and FIG. 11 is a diagram depicting an example of velocity components in the bucket.

The controller 40 performs, as boom control in MC, boom raising control by the boom control section 81*a*. The processing by the boom control section 81*a* is started when the operation device 45*a*, 45*b*, or 46*a* is operated by the operator.

In FIG. 7, when the operation device 45*a*, 45*b*, or 46*a* is operated by the operator, the boom control section 81*a* calculates an operation velocity (cylinder velocity) of each of the hydraulic cylinders 5, 6, and 7 based on the operation amount calculated by the operation amount calculation section 43*a* (step S410). Specifically, as depicted in FIG. 9, the cylinder velocities relative to operation amounts preliminarily determined empirically or by simulation are set as a table, and the cylinder velocity of each of the hydraulic cylinders 5, 6, and 7 is calculated according to the table.

Subsequently, the boom control section 81*a* calculates a velocity vector B of the bucket tip end (claw tip) by the operator operation, based on the operation velocity of each of the hydraulic cylinders 5, 6, and 7 calculated in step S410 and the posture of the front work device 1A calculated by the posture calculation section 43*b* (step S420).

Subsequently, the boom control section 81*a* calculates a limit value "ay" for a component perpendicular to the target surface 60 of the velocity vector of the bucket tip end, based on the distance D and the relation depicted in FIG. 10 (step S430).

Subsequently, the boom control section 81*a* acquires a component "by" perpendicular to the target surface 60, with respect to the velocity vector B of the bucket tip end by the operator operation calculated in step S420 (step S440).

Subsequently, the boom control section 81*a* determines whether or not the limit value "ay" calculated in step S430 is equal to or more than 0 (step S450). Note that an xy coordinates for the bucket 10 are set as depicted in FIG. 11. In the xy coordinates of FIG. 11, an x axis is parallel to the target surface 60, and the rightward direction in the figure is positive, whereas a y axis is perpendicular to the target surface 60, and the upward direction in the figure is positive. In FIG. 11, the perpendicular component "by" and the limit value "ay" are negative, while the horizontal component bx, the horizontal component cx, and a perpendicular component "cy" are positive. As is clear from FIG. 10, when the limit value "ay" is 0, the distance D is 0, that is, the claw tip is located on the target surface 60, when the limit value "ay" is positive, the distance D is negative, that is, the claw tip is located below the target surface 60, and when the limit value "ay" is negative, the distance D is positive, that is, the claw tip is located above the target surface 60.

When the result of determination in step S450 is YES, that is, when the limit value "ay" is determined to be equal to or more than 0 and where the claw tip is located on the target surface 60 or on the lower side thereof, the boom control section 81*a* determines whether or not the perpendicular component "by" of the velocity vector B of the claw tip by the operator operation is equal to or more than 0 (step S460). When the perpendicular component "by" is positive, it is indicated that the perpendicular component "by" of the velocity vector B is upward, whereas, when the perpendicular component "by" is negative, it is indicated that the perpendicular component "by" of the velocity vector B is downward.

When the result of determination in step S460 is YES, that is, when the perpendicular component "by" is determined to be equal to or more than 0 and where the perpendicular component "by" is upward, the boom control section 81*a* determines whether or not the absolute value of the limit value "ay" is equal to or more than the absolute value of the perpendicular component "by" (step S470). When the results of this determination is YES, the boom control section 81*a* selects "cy=ay−by" as a formula for calculating the component "cy" perpendicular to the target surface 60 of a velocity vector C of the bucket tip end to be generated by the operation of the boom 8 by machine control, and calculates the perpendicular component "cy" based on the formula, the limit value "ay" calculated in step S430, and the perpendicular component "by" calculated in step S440 (step S500).

Subsequently, the boom control section 81*a* calculates the velocity vector C capable of outputting the perpendicular component "cy" calculated in step S500 and set its horizontal component as cx (step S510).

Subsequently, the boom control section 81*a* calculates a target velocity vector T (step S520) and proceeds to step S550. Let the component perpendicular to the target surface 60 of the target velocity vector T be "ty," and let the horizontal component be "tx," then "ty" and "tx" can be represented respectively as "ty=by+cy, tx=bx+cx." When cy=ay−by calculated in step S500 is put into this expression, the target velocity vector T is "ty=ay, tx=bx+cx." In other words, the perpendicular component "ty" of the target velocity vector in a case of reaching the processing in step S520, the limit value "ay" is limited, and control of forced boom raising by machine control is effected.

When the result of determination in step S450 is NO, that is, when the limit value "ay" is less than 0, the boom control section 81*a* determines whether or not the perpendicular component "by" of the velocity vector B of the claw tip by the operator operation is equal to or more than 0 (step S480). When the result of determination in step S480 is YES, the control proceeds to step S530, whereas when the result of determination is NO, the control proceeds to step S490.

When the result of determination in step S480 is NO, that is, when the perpendicular component "by" is less than 0, the boom control section 81*a* determines whether or not the absolute value of the limit value "ay" is equal to or more than the absolute value of the perpendicular component "by" (step S490). When the result of this determination is YES, the control proceeds to step S530, whereas, when the result of determination is NO, the control proceeds to step S500.

When the result of determination in step S480 is YES, that is, when the perpendicular component "by" is determined to be equal to or more than 0 (when the perpendicular component "by" us upward), or when the result of determination in step S490 is YES, that is, when the absolute value of the limit value "ay" is less than the absolute value of the perpendicular component "by," the boom control section 81*a* determines that it is unnecessary to operate the boom 8 by machine control and sets the velocity vector C to zero (step S530).

Subsequently, the boom control section 81*a* sets the target velocity vector T to be "ty=by, tx=bx" based on the formulas (ty=by+cy, tx=bx+cx) utilized in step S520 (step S540). This is coincident with the velocity vector B by the operator operation.

When the processing in step S520 or step S540 is finished, subsequently, the boom control section 81*a* calculates target velocities for the hydraulic cylinders 5, 6, and 7 based on the target velocity vector T (ty, tx) determined in step S520 or step S540 (step S550). Note that, while it is clear from the above description, when the target velocity vector T is not coincident with the velocity vector B, the target velocity vector T is realized by adding the velocity vector C generated in the operation of the boom 8 by machine control to the velocity vector B.

Subsequently, the boom control section 81*a* calculates target pilot pressures for the flow control valves 15*a*, 15*b*, and 15*c* of the hydraulic cylinders 5, 6, and 7 based on the target velocities for the cylinders 5, 6, and 7 calculated in step S550 (step S560).

Subsequently, the boom control section 81*a* outputs, to the solenoid proportional valve control section 44, the target pilot pressures for the flow control valves 15*a*, 15*b*, and 15*c* of the hydraulic cylinders 5, 6, and 7 (step S570) and finishes the processing.

With the processing of the flow chart depicted in FIG. 7 carried out in this way, the solenoid proportional valve control section 44 controls the solenoid proportional valves 54, 55, and 56 such that the target pilot pressures act on the flow control valves 15*a*, 15*b*, and 15*c* of the hydraulic cylinders 5, 6, and 7, and excavation by the front work device 1A is conducted. For example, when the operator operates the operation device 45*b* and horizontal excavation is performed by an arm crowding operation, the solenoid proportional valve 55*c* is controlled such that the tip end of the bucket 10 does not enter into the target surface 60, and a raising operation of the boom 8 is automatically carried out.

<Bucket Control According to MC (Bucket Control Section 81*b*, Bucket Control Determination Section 81*c*)>

Next, details of the bucket control according to MC will be described.

Figure 12:
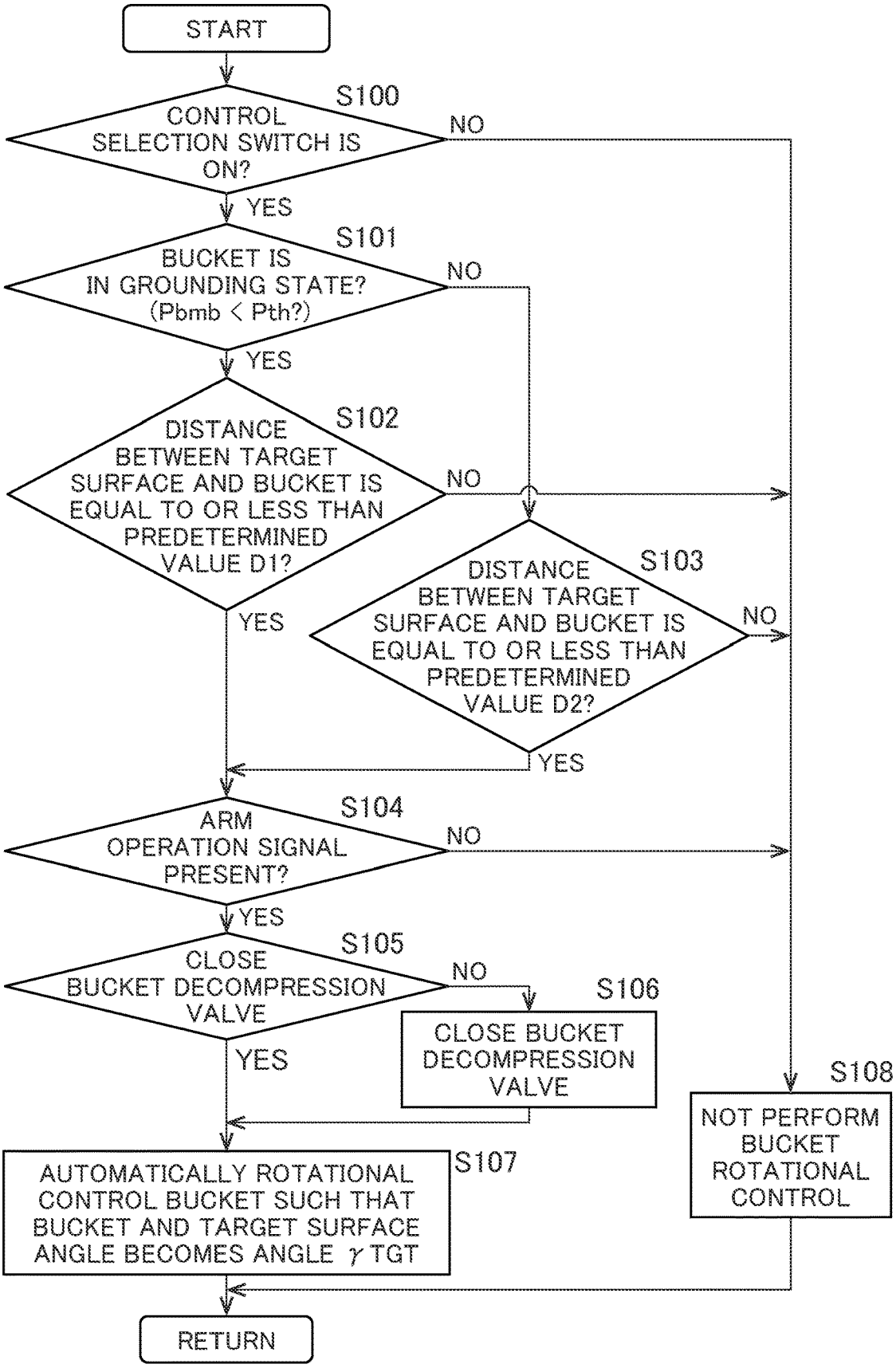
FIG. 12 is a flow chart depicting the contents of processing with respect to the bucket in the MC by the controller.

FIG. 12 is a flow chart depicting the contents of processing with respect to the bucket in MC by the controller.

The controller 40 performs, as bucket control in MC, bucket rotational control by the bucket control section 81*b* and the bucket control determination section 81*c*. The bucket rotational control is bucket angle control of controlling the relative angle of the bucket 10 with respect to the target surface 60.

In FIG. 12, first, the bucket control determination section 81*c* determines whether or not the control selection device 97 is switched over to ON (that is, bucket angle control is effective) (step S100), and, when the result of this determination is NO, bucket rotational control of controlling the angle of the bucket 10 is not carried out (step S108), and the processing is finished. In this case, a command is sent to none of the four solenoid proportional valves 56*a*, 56*b*, 56*c*, and 56*d*.

In addition, when the result of determination in step S100 is YES, that is, when the control selection device 97 is ON (bucket angle control is effective), subsequently the bucket control determination section 81*c* determines whether or not the bucket 10 is grounded on soil (step S101). The determination whether or not the bucket 10 is grounded on soil is performed by comparing a bottom pressure Pbmb of the boom cylinder 5 detected by the bucket grounding state sensor (pressure sensor 57) and a predetermined threshold value Pth, and, when the bottom pressure Pbmb is smaller than the threshold value Pth, it is determined that the bucket 10 is in a grounding state.

When the result of determination in step S101 is YES, that is, when it is determined that the bucket 10 is in a grounding state, subsequently the bucket control determination section 81*c* determines whether or not the distance D between the claw tip of the bucket 10 and the target surface 60 is equal to or less than a predetermined value D1 (step S102), and, when the result of this determination is YES, the control proceeds to step S104.

In addition, when the result of determination in step S101 is NO, that is, when the bucket 10 is determined not to be in a grounding state, the bucket control determination section 81*c* determines whether or not the distance D between the claw tip of the bucket 10 and the target surface 60 is equal to or less than a predetermined value D2 (step S103), and, when the result of this determination is YES, the control proceeds to step S104.

The predetermined values D1 and D2 of the distance between the bucket 10 and the target surface 60 can be said to be values for determining the start timing of the bucket angle control (bucket rotational control) in MC. The predetermined value D2 is preferably set to as small a value as possible from the viewpoint of reducing the discomfort which the effecting of the bucket angle control gives to the operator. Besides, the predetermined value D1 is preferably set to a value larger than the predetermined value D2, by estimating that soil is piled above the target surface. In addition, the distance D from the claw tip of the bucket 10 to the target surface 60 that is utilized in steps S102 and S103 can be calculated from the position (coordinates) of the claw tip of the bucket 10 calculated by the posture calculation section 43*b* and the distance of straight lines including the target surface 60 that is stored in the ROM 93. Note that the reference point of the bucket 10 at the time of calculating the distance D is not necessary to be the bucket claw tip (the front end of the bucket 10), but may be a point of the bucket 10 at which the distance to the target surface 60 is minimized, or may be the rear end of the bucket 10.

When the result of determination in step S102 is YES, that is, when the distance D is equal to or less than the predetermined value D1, or when the result of determination in step S103 is YES, that is, when the distance D is equal to or less than the predetermined value D2, the bucket control determination section 81*c* determines whether or not an operation signal for the arm 9 by the operator is present, based on the signal from the operation amount calculation section 43*a* (step S104).

When the result of determination in step S104 is YES, that is, when an operation signal for the arm 9 is present, the bucket control determination section 81*c* determines whether or not an operation signal for the bucket 10 by the operator is present, based on the signal from the operation amount calculation section 43*a* (step S105), and, when the result of this determination is NO, the bucket control section 81*b* outputs a command such as to close the solenoid proportional valves (bucket pressure reducing valves) 56*a* and 56*b* provided in the pilot lines 146*a* and 146*b* of the bucket 10 (step S106). As a result, the bucket 10 is prevented from being rotated by an operator operation through the operation device 46*a*.

In addition, when the result of determination in step S105 is YES, that is, when an operation signal for the bucket 10 is absent, or when the processing of step S106 is finished, subsequently the bucket control section 81*b* outputs a command such as to open the solenoid proportional valves (bucket pressure increasing valves) 56*c* and 56*d* provided in the pilot line 148*a* of the bucket 10, performs rotational control on the bucket cylinder 7 such that the target bucket angle becomes a set value γTGT (step S107), and finishes the processing.

Besides, when the result of determination in any one of steps S102, S103, S104 is NO, the control proceeds to step S108.

Note that, in the present embodiment, a case of performing the boom control (forced boom raising control) by the boom control section 81*a* and the bucket control (bucket angle control) by the bucket control section 81*b* and the bucket control determination section 81*c* as MC has been illustrated as an example, but boom control according to the distance D between the bucket 10 and the target surface 60 may be performed as MC.

Effects of the present embodiment configured as above will be described.

Figure 13:
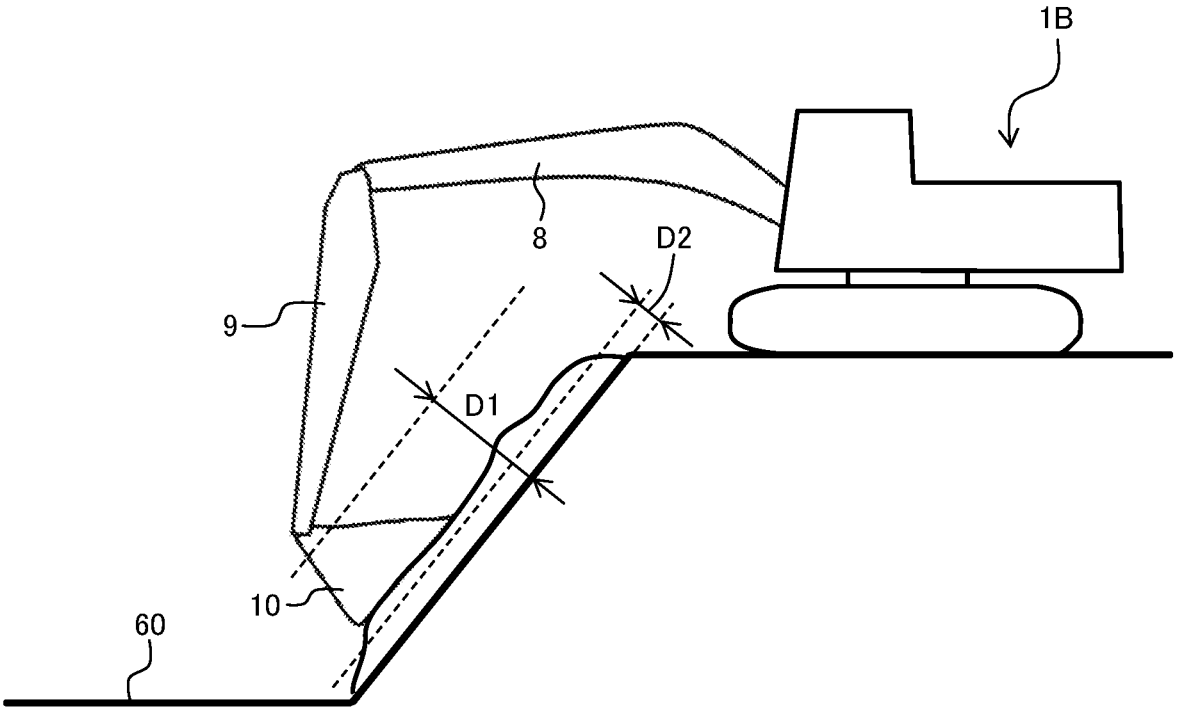
FIG. 13 is a diagram depicting the manner of a bucket pressing operation.

FIG. 13 is a diagram for explaining the effects of the present embodiment, and is a diagram depicting the manner of a bucket pressing operation.

As illustrated in FIG. 13, in the case of performing an operation of piling soil above the target surface 60 and finishing the excavation surface while keeping constant the bucket angle on the upper side of the soil and pressing the bucket, for pressing and consolidating the excavation surface, in the prior art, when the threshold value of the distance between the bucket and the target surface at which control for maintaining the bucket angle is started is set large like D1, for example, when the front work device is operated in air above the target surface for returning the bucket to the excavation starting position and the bucket enters the area of equal to or less than the threshold value D1, driving is conducted such that the bucket angle is maintained, and control is performed by an action which is not the excavation action, so that a discomfort may be given to the operator. In addition, when, for avoiding this problem, D2 smaller than the threshold value D1 is set as a threshold value as depicted in FIG. 13, the distance between the bucket and the target surface at the time of piling soil on the target surface 60 is not equal to or less than the threshold value D2, due to the pressing and consolidating operation as described above, and control for maintaining the bucket angle may not be started.

On the other hand, in the present embodiment, the work machine (hydraulic excavator 1) including the articulated front work device 1A configured by coupling, in a mutually rotatable manner, a plurality of driven members (the boom 8, the arm 9, and the bucket 10) including a work tool (for example, the bucket 10) provided at a tip end, a plurality of hydraulic actuators (the boom cylinder 5, the arm cylinder 6, and the bucket cylinder 7) that respectively drive the plurality of driven members on the basis of operation signals, the operation devices 45*a*, 45*b*, and 46*a* that each output an operation signal to, of the plurality of hydraulic actuators, a hydraulic actuator desired by an operator, the posture sensors (the boom angle sensor 30, the arm angle sensor 31, the bucket angle sensor 32, and the machine body inclination angle sensor 33) that detect respective postures of the plurality of driven members of the front work device, and the controller 40 that performs area limiting control of outputting the operation signal to at least one hydraulic actuator of the plurality of hydraulic actuators or correcting the operation signal, such that the front work device moves on the target surface 60 set for an object of work by the front work device or an area on an upper side of the target surface 60, further includes the grounding state sensor (pressure sensor 57) that detects a grounding state of the work tool on soil. The controller is configured to output or correct the operation signal such that a relative angle of the work tool with respect to the target surface is maintained if a distance between the work tool and the target surface is equal to or less than a preset first threshold value D1 when it is determined, on the basis of a result of detection by the grounding state sensor, that the work tool is grounded on the soil. The controller is configured to output or correct the operation signal such that the relative angle of the work tool with respect to the target surface is maintained if the distance between the work tool and the target surface is equal to or less than a preset second threshold value D2 set smaller than the first threshold value D1 when it is determined, on the basis of the result of detection by the grounding state sensor, that the work tool is not grounded on the soil. Therefore, control for maintaining the angle of the work tool can be started suitably.

In other words, at the time of performing an operation of maintaining the bucket angle in a state in which soil is piled above the target surface as depicted in FIG. 13, the load on the front work device is borne by the ground by pressing of the bucket 10 against soil, and the bottom pressure of the boom cylinder 5 becomes less than the threshold value Pth, so that the threshold value D of the distance between the bucket and the target surface for starting control of maintaining the bucket angle is D1, the D1 is sufficiently larger than the thickness of soil piled on the target surface, and, therefore, control is started such as to maintain the bucket angle. In addition, at the time of moving the bucket in air to the work starting position, the load on the front work device is maintained by the boom cylinder 5, so that the bottom pressure of the boom cylinder 5 becomes larger than the threshold value Pth. Therefore, the threshold value D of the distance between the bucket and the target surface for starting control of maintaining the bucket angle is D2, the threshold value D2 is set to as small a value as possible, and, therefore, the control of maintaining the bucket angle is not started, and control can be performed such as not to give a discomfort to the operator's operation.

Next, characteristic features of each of the above embodiments will be described.

(1) In the above embodiment, the work machine (for example, the hydraulic excavator 1) including the articulated front work device 1A configured by coupling, in a mutually rotatable manner, a plurality of driven members (for example, the boom 8, the arm 9, and the bucket 10) including the work tool (for example, the bucket 10) provided at the tip end, a plurality of hydraulic actuators (for example, the boom cylinder 5, the arm cylinder 6, and the bucket cylinder 7) that respectively drive the plurality of driven members on the basis of operation signals, the operation devices 45*a*, 45*b*, and 46*a* that each output an operation signal to, of the plurality of hydraulic actuators, the hydraulic actuator desired by the operator, the posture sensors (for example, the boom angle sensor 30, the arm angle sensor 31, the bucket angle sensor 32, and the machine body inclination angle sensor 33) that detect respective postures of the plurality of driven members of the front work device, and the controller 40 that performs area limiting control of outputting the operation signal to at least one hydraulic actuator of the plurality of hydraulic actuators or correcting the operation signal, such that the front work device moves on the target surface set for the object of work by the front work device or an area on the upper side of the target surface, further includes the grounding state sensor (for example, the pressure sensor 57) that detects the grounding state of the work tool on soil. The controller is configured to output or correct the operation signal such that the relative angle of the work tool with respect to the target surface is maintained if the distance between the work tool and the target surface is equal to or less than a preset first threshold value (for example, a predetermined value D1) when it is determined, on the basis of the result of detection by the grounding state sensor, that the work tool is grounded on the soil. The controller is configured to output or correct the operation signal such that the relative angle of the work tool with respect to the target surface is maintained if the distance between the work tool and the target surface is equal to or less than a preset second threshold value (for example, a predetermined value D2) set smaller than the first threshold value when it is determined, on the basis of the result of detection by the grounding state sensor, that the work tool is not grounded on the soil.

As a result, control of maintaining the angle of the work tool can be started suitably.

(2) In addition, in the above embodiment, in the work machine (for example, the hydraulic excavator 1) of (1), the front work device 1A includes, as the plurality of driven members, the boom 8 having a base end rotatably coupled to the main body of the work device, the arm 9 having one end rotatably coupled to the tip end of the boom, and the work tool (for example, the bucket 10) rotatably coupled to the other end of the arm, and the grounding state sensor is the pressure sensor 57 that detects the cylinder pressure of the boom cylinder 5 as the hydraulic actuator for driving the boom.

(3) Besides, in the above embodiment, in the work machine (for example, the hydraulic excavator 1) of (1), the grounding state sensor is a camera device that images the front work device.

(4) In addition, in the above embodiment, the work machine (for example, the hydraulic excavator 1) of any one of (1) to (3) further includes the control selection device 97 that alternatively selects validity and invalidity of the area limiting control by the controller 40.

<Additional Remark>

Note that the present invention is not limited to the above-described embodiment, but includes various modifications and combinations within such a range as not to depart from the gist of the invention. In addition, the present invention is not limited to those including all the configurations described in the above embodiment, but includes those in which part of the configurations is deleted. Besides, part or the whole of the above configurations, functions and the like may be realized, for example, by designing in the form of an integrated circuit. In addition, the above configurations, functions, and the like may be realized on a software basis by a processor interpreting and executing programs for realizing the respective functions.

DESCRIPTION OF REFERENCE CHARACTERS

1: Hydraulic excavator
1*a*, 1*b*: Operation lever
1A: Front work device
1B: Main body
2, 2*a*, 2*b*: Hydraulic pump
2*aa*, 2*ba*: Regulator
3*a*, 3*b*: Track hydraulic motor
4: Swing hydraulic motor
5: Boom cylinder
6: Arm cylinder
7: Bucket cylinder
8: Boom
9: Arm
10: Bucket
11: Lower track structure
12: Upper swing structure
13: Bucket link
15*a* to 15*f*: Flow control valve
18: Engine
23: Operation lever
30: Boom angle sensor
31: Arm angle sensor

32: Bucket angle sensor
33: Machine body inclination angle sensor
39: Lock valve
40: Controller
43: MC control section
43*a*: Operation amount calculation section
43*b*: Posture calculation section
43*c*: Target surface calculation section
43*d*: Distance calculation section
44: Solenoid proportional valve control section
45 to 47: Operation device
48: Pilot pump
50: Work device posture sensor
51: Target surface setting device
53: Display device
54 to 56: Solenoid proportional valve
57: Pressure sensor
60: Target surface
70 to 72: Pressure sensor
81: Actuator control section
81*a*: Boom control section
81*b*: Bucket control section
81*c*: Bucket control determination section
82*a*, 83*a*, 83*b*: Shuttle valve
91: Input interface
92: Central processing unit (CPU)
93: Read only memory (ROM)
94: Random access memory (RAM)
95: Output interface
96: Target angle calculation section
97: Control selection device
144 to 149: Pilot line
150*a*, 152*a*, 152*b*, 155*b*: Hydraulic driving section
0160: Front control hydraulic unit
162: Shuttle block
200: Hydraulic operating oil tank
374: Display control section

The invention claimed is:

1. A hydraulic excavator comprising:

an articulated front work device including, as a plurality of driven members, a boom having a base end rotatably coupled to a main body of the hydraulic excavator, an arm having one end rotatably coupled to a tip end of the boom, and a bucket rotatably coupled to another end of the arm;

a plurality of hydraulic actuators that respectively drive the plurality of driven members on a basis of an operation signal;

an operation device that outputs the operation signal to, of the plurality of hydraulic actuators, a hydraulic actuator desired by an operator;

a posture sensor that detects respective postures of the plurality of driven members of the front work device;

a controller configured to perform area limiting control of outputting the operation signal to at least one hydraulic actuator of the plurality of hydraulic actuators or correcting the operation signal, such that the bucket is located on a target surface, which is set for a target of excavation work on ground to be excavated or an upper side of the target surface, to excavate along the target surface; and a grounding state sensor that detects a grounding state of the bucket on soil of the ground, wherein the controller is configured to:

output or correct the operation signal to maintain an angle of the bucket with respect to the target surface to be constant to the hydraulic actuator corresponding to the bucket, (i-1) in the case of determining, on a basis of a result of detection by the grounding state sensor, that the bucket is grounded on the soil on the target surface, and a distance between the bucket and the target surface is equal to or less than a preset first threshold value, or (i-2) in the case of determining, on the basis of the result of detection by the grounding state sensor, that the bucket is not grounded on the soil on the target surface, and a distance between the bucket and the target surface is equal to or less than a preset second threshold value that is smaller than the first threshold value, and not output or correct the operation signal that maintains the angle of the bucket with respect to the target surface to be constant to the hydraulic actuator corresponding to the bucket, (ii-1) in the case of determining, on a basis of a result of the detection by the grounding state sensor, that the bucket is grounded on the soil on the target surface, and a distance between the bucket and the target surface is larger than the first threshold value, or (ii-2) in the case of determining, on the basis of the result of detection by the grounding state sensor, that the bucket is not grounded on the soil, and a distance between the bucket and the target surface is larger than the second threshold value.

2. The hydraulic excavator according to claim 1, wherein the grounding state sensor is a pressure sensor that detects a cylinder pressure of a boom cylinder which is a hydraulic actuator for driving the boom, and wherein the controller is configured to determine that the bucket is grounded on the soil on the target surface when the detection result of the pressure sensor is smaller than a predetermined pressure threshold.

3. The hydraulic excavator according to claim 1, wherein the grounding state sensor is a camera device that images the front work device.

4. The hydraulic excavator according to claim 1, further comprising:

a control selection device that alternatively selects validity and invalidity of the area limiting control by the controller.

* * * * *